United States Patent [19]

Morgan et al.

[11] Patent Number: 4,726,927

[45] Date of Patent: Feb. 23, 1988

[54] METHOD AND APPARATUS FOR FORMING PRESSED POWDER METAL PARTS HAVING MULTIPLE CAVITIES

[75] Inventors: Ricky D. Morgan, Ulster; Vito P. Sylvester, Athens, both of Pa.

[73] Assignee: GTE Products Corporation, Stamford, Conn.

[21] Appl. No.: 18,670

[22] Filed: Feb. 25, 1987

[51] Int. Cl.[4] ..... B22F 7/00

[52] U.S. Cl. ..... 419/9; 419/26; 419/28; 419/42; 419/49; 419/68; 249/83; 249/91; 425/123

[58] Field of Search ..... 419/9, 68, 42, 26, 49, 419/28; 249/83, 91; 425/123

[56] References Cited

U.S. PATENT DOCUMENTS

| | | | |
|---|---|---|---|
| 3,804,617 | 4/1974 | Conklin | 419/26 |
| 3,818,581 | 6/1974 | Vartanian et al. | 419/28 |
| 3,996,048 | 12/1976 | Fiedler | 419/26 |
| 4,587,707 | 5/1986 | Nishida et al. | 419/28 |
| 4,657,822 | 4/1987 | Goldstein | 419/28 |

*Primary Examiner*—Stephen J. Lechert, Jr.
*Attorney, Agent, or Firm*—Donald R. Castle; L. Rita Quatrini

[57] ABSTRACT

A method and apparatus are disclosed for producing a powder metal part having a plurality of cavities. The method involves introducing a metal powder and an apparatus into a mold, the apparatus being made of a plurality of solid pieces which are in the shape of the cavities to be formed. The pieces are joined together by joining means and are positioned relative to each other by adjusting means so that the cavities formed therefrom are equally spaced about the center of the part. The apparatus is then removed from the mold, and the powder is then isostatically pressed in the mold to produce a green part which is then sintered to form the final part having the cavities.

2 Claims, 2 Drawing Figures

METHOD AND APPARATUS FOR FORMING PRESSED POWDER METAL PARTS HAVING MULTIPLE CAVITIES

This invention relates to a method and apparatus forming pressed powder metal parts having multiple cavities. More particularly, the multiple cavities are arranged at equal distances from the center of the part.

BACKGROUND OF THE INVENTION

Powder metallurgy is a process used to produce finished metal products similar to those manufactured in the steel industry. However, in the steel industry, various raw materials are mixed and melted in furnaces. The molten steel is poured into ingots and allowed to cool to form solid steel. The steel can then be worked and machined into products. In powder metallurgical processing, the starting material is a metal powder which is placed into a mold similar in shape to the desired finished product. This results in subsequent formation of a product that is near-net shape, to the desired finished product. The mold is typically rubber-like and is placed into a steel container so it will retain its shape when the powder is loaded into it. If a hole or cavity is desired in the finished product, it can be formed in the powder by using a solid shape of calculated size inside the mold. The shape (called a mandrel) is surrounded by the metal powder. After the required amount of powder is loaded into the mold, the mold is sealed by either mechanical means or liquid rubber, thus encapsulating the powder with rubber. Then, depending on the type of mandrel used, the mandrel is either extracted (removal type) or left in the mold (solid type). The apparatus is then isostatically pressed (pressure from all directions) using an oil or water medium. The part is now in the "green" or as-pressed state. The part can be handled and moved, but if it is dropped or jarred, it will chip or crack. The as-pressed part is placed in a furnace and heated to a temperature below its melting point to result in coalescence of the powder particles and formation of a solid article. This process is called sintering. The as-sintered part is the finished product. If necessary the as-sintered product can be worked or machined.

Therefore, the two main advantages of powder metallurgy are (1) a minimum weight of material is required to make the part due to forming to near-net-shape, and (2) there is a reduced energy consumption since the metal does not have to be melted.

The one disadvantage of powder metallurgy processing is the inability to achieve theoretical density of the metal without extraordinary means. To fully appreciate this problem, the shrinkage/density change from powder to as-sintered article must be understood. Metal powder is approximately 30% of theoretical density. The as pressed or green part is approximately 60% of theoretical density, and the as-sintered part usually has a density range of from about 92% to about 97% of the theoretical density. As the density increases, the part shrinks. This shrinkage can be calculated and is commonly referred to as the shrink factor.

The shrinkage factor becomes more complicated with tubes and crucibles. If a solid mandrel (one that remains in the mold during pressing) is used, the shrinkage from the green to sintered state must be used in determining the cavity size. If a removable mandrel (one that is extracted from the mold before pressing) is used, the powder to sintered shrink factor must be used.

When a removable mandrel is used, another mold must initially encapsulate the mandrel. This is because the mandrel is extracted before pressing and the cavity left after extraction is filled with water during pressing. Now, as the part is shrinking, it, of course, contracts toward the center. However, if multiple cavities are to be formed, each cavity itself shrinks and all the cavities shrink toward the center of the part.

The ability to form more than one cavity in a powder metal isostatically pressed part as opposed to machining the multiple cavities in the part has two major advantages. They are that (1) less feed material is required, and (2) less machining time is required since less material is in the sintered blank.

The present invention provides a method for providing powder metallurgically produced isostatically pressed parts having a plurality of cavities.

SUMMARY OF THE INVENTION

In accordance with one aspect of this invention, there is provided a method for producing a powder metal part having a plurality of cavities. The method involves introducing a metal powder and an apparatus into a mold, the apparatus being made of a plurality of solid pieces which are in the shape of the cavities to be formed. The pieces are joined together by joining means. The pieces are positioned relative to each other by adjusting means so that the cavities formed therefrom are equally spaced about the center of the part. The apparatus is then removed from the mold. The powder is then isostatically pressed in the mold to produce a green part which is then sintered to form the final part having the cavities.

In accordance with another aspect of this invention, there is provided the above described apparatus for producing the above described part.

DETAILED DESCRIPTION OF THE INVENTION

Figure 1:
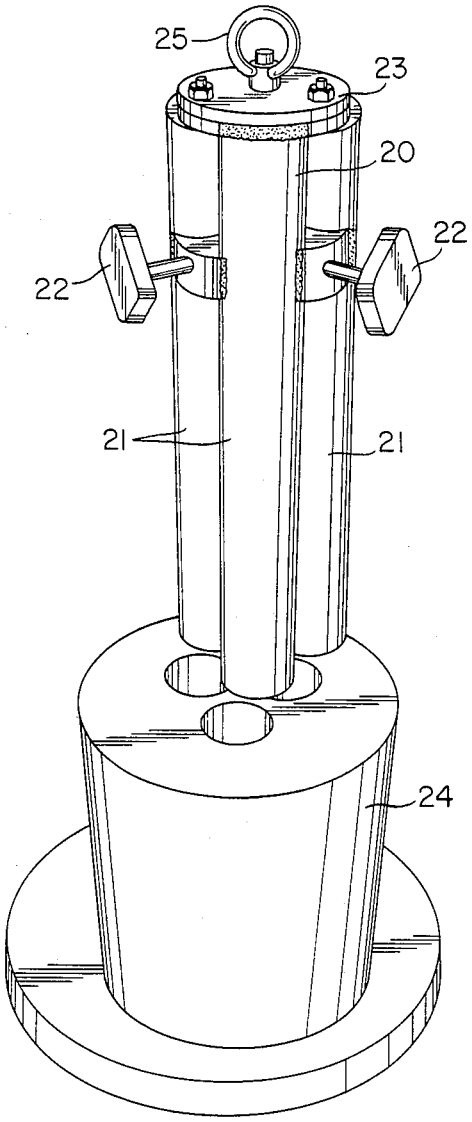
FIG. 1 is a photograph showing the apparatus of the present invention and a typical multiple cavity part produced by the method of the present invention using the shown apparatus.

For a better understanding of the present invention, together with other and further objects, advantages and capabilities thereof, reference is made to the following disclosure and appended claims in connection with the above described Figures and description of some of the aspects of the invention.

This invention provides a method and apparatus for producing a powder metal part having a plurality of cavities.

The powder metal can be of any metal or alloy. The invention is specifically applicable to tungsten alloy parts. One alloy which is especially suitably to the method of the present invention using the apparatus is GTE tungsten alloy WN205F which is a tungsten-nickel alloy which has a weight composition of about 4% iron, about 4% nickel, and the balance tungsten.

The metal powder is introduced into a mold with an apparatus which is a plurality of solid pieces or mandrels which are joined together. The mandrels are in the shape of the cavities which are to formed in the part.

The calculation of where the mandrels should be placed and what size the mandrels should be are determined using the powder to sinter shrink factor. This is the cube root of the powder tap density divided by the expected sintered density.

The pieces are equally spaced about the center of the mold. This means that the distances from the center of the mold (or the center of the subsequently produced part) to the center of each piece are equal. The requirement of equal spacing around the center necessitates a one piece apparatus with the mandrels being interconnected. The preferred method of interconnecting the mandrels are by joining means along the sides and/or on the top. The joining means can be generally any such means. However, the preferred means are bolts, welds, and adjusting screws and fixtures and combinations of these, or other appropriate means. The mandrels are of the removable type. To insure equal spacing of the mandrels around the center of the part, adjusting means are attached to the spacings between mandrels. The adjusting means can be any such means as long as it holds the mandrels in their correct positions. It is preferred to use brackets and/or adjusting screws or arms. The joining means can serve also as the adjusting means if its design allows the mandrels to be positioned correctly. If the joining means does not accomplish this, then a separate adjusting means must be provided.

The apparatus can be placed in the center of the mold.

There can be any number of cavities in the finished part, and therefore the apparatus can have any number of pieces or mandrels. The mandrels can be of any shape depending on the openings desired.

The cavities in the part do not necessarily have to be of the same height as the part but can be of any height within the part.

The powder is placed in the mold and leveled. The removable mandrels are then placed in the mold on top of the leveled powdered already in the mold and centered using the adjusting means. The apparatus of mandrels will be removed after the mold is filled with powder and sealed with a sealing means which is preferably liquid rubber. Each of the pieces or mandrels has a mold on it and these mandrel molds remain in the powder containing mold and serve to maintain the cavities made by the mandrels. The interconnection of the mandrels both along the sides and on the top allows all the mandrels to be removed from the mold simultaneously in a straight fashion. Typically there is a handling fixture on the top of the apparatus for inserting and removing the apparatus from the mold.

FIG. 1 is a photograph of a typical apparatus showing three mandrels having an interconnection along the top with the handling fixture, and adjustable parts along the side which serve to join the mandrels and to adjust their relative positions.

The metal powder with the above described apparatus of mandrels is then isostatically pressed at room temperature to form the green part. Pressures of from about 15 to about 60 kpsi are typical. The pressing is done preferably at room temperature.

The green part is then sintered to form the final part having cavities in the shape of the mandrels. The cavities are spaced in the exact positions calculated and are the calculated size.

Figure 2:
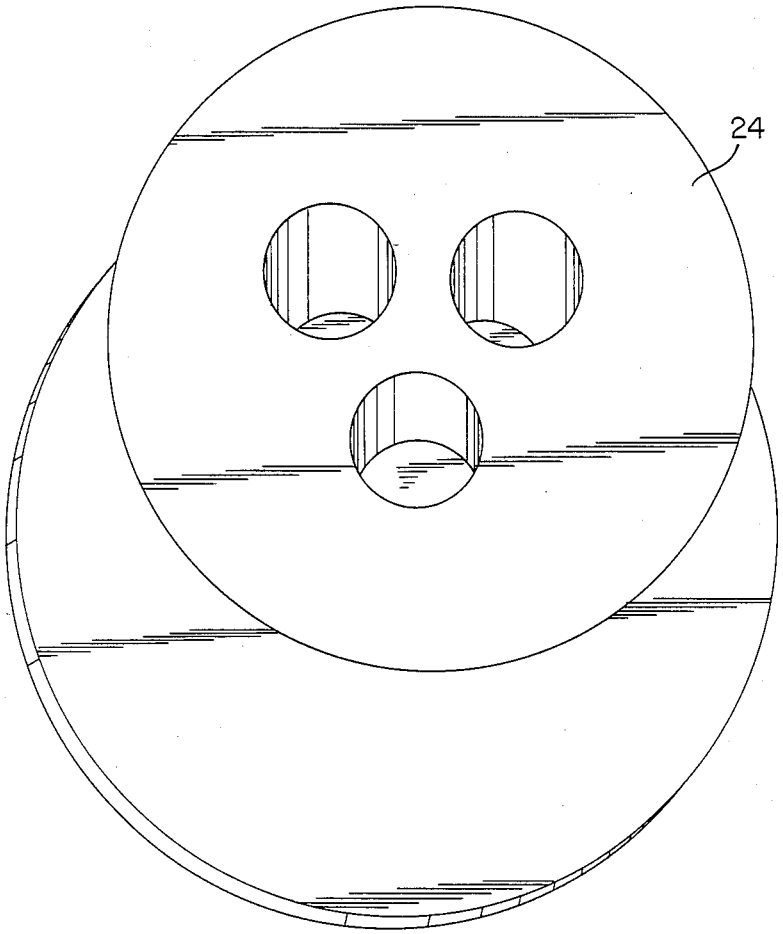
FIG. 2 is a photograph of a typical multiple cavity part produced by the method of the present invention using the apparatus of the present invention.

FIG. 2 is a photograph showing a typical tungsten metal alloy part having three cavities equally spaced around the center of the part.

To more fully illustrate this invention, the following nonlimiting example is presented.

EXAMPLE

The following is an example of how a part is made of a tungsten metal alloy having a diameter of about 20.500" and a height of about 26.600" and having three cavities each of about 5.980" in diameter equally spaced about the center of the part on a 7.250" bolt circle. The bolt circle is an imaginary circle that runs through the center of the pieces. The calculation of where the mandrels should be placed and what size mandrels should be used are figured using the powder to sinter shrink factor. An apparatus is made of three removable mandrels which are interconnected along their sides by small adjustable parts and on the top. This insures equal spacing between the mandrels and that they lie on a specified bolt circle. The metal powder is placed in the mold. The apparatus is placed int he mold. Then additional powder is placed around the apparatus. The mandrels which have molds on them are then removed leaving the part with three cavities equally spaced around the center of the part. The cavities have the size which is calculated using the powder to sinter shrink factor. The powder is then isostatically pressed at room temperature and a pressure of from about 15 to about 60 kpsi to form the green part which is sintered in hydrogen at a temperature of from about 1300° C. to about 1600 ° C.

While there has been shown and described what are at present considered the preferred embodiments of the invention, it will be obvious to those skilled in the art that various changes and modifications may be made therein without departing from the scope of the invention as defined by the appended claims.

What is claimed is:

1. A method for producing a powder metal part having a plurality of cavities, and said method comprising:

(a) introducing a metal powder into a powder mold;

(b) forming cavities in said metal powder in said mold by introducing an apparatus into said powder mold, said apparatus being made of a plurality of solid mandrels, each mandrel having around it a mandrel mold in the shape of the respective cavities which are to be formed, said mandrels being joined together by joining means, said mandrels being positioned relative to each other by adjusting means so that the cavities formed therefrom are equally spaced about the center of said part;

(c) removing said mandrels from said powder mold, while allowing said mandrel molds to remain in position in said powder mold;

(d) isostatically pressing said metal powder to produce a green part; and (e) sintering said green part to form said part having said cavities.

2. An apparatus for forming a plurality of cavities in a powder metal part, with said cavities being spaced at equal distances from the center of said part, said apparatus comprising a plurality of solid mandrels, each mandrel having around it a mandrel mold in the shape of the respective cavities to be formed, said mandrels being removeable from said mandrel molds, said mandrels being joined together by joining emans, said mandrels being positioned relative to each other by adjusting means so that the cavities formed therefrom are equally spaced about the center of said part.

* * * * *